US009829231B2

(12) United States Patent
Fukui et al.

(10) Patent No.: US 9,829,231 B2
(45) Date of Patent: Nov. 28, 2017

(54) REFRIGERATION CYCLE APPARATUS

(75) Inventors: Koji Fukui, Tokyo (JP); Fumitake Unezaki, Tokyo (JP); Makoto Saito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 936 days.

(21) Appl. No.: 13/822,726

(22) PCT Filed: Oct. 4, 2011

(86) PCT No.: PCT/JP2011/005597
§ 371 (c)(1),
(2), (4) Date: Mar. 13, 2013

(87) PCT Pub. No.: WO2012/049820
PCT Pub. Date: Apr. 19, 2012

(65) Prior Publication Data

US 2013/0167567 A1 Jul. 4, 2013

(30) Foreign Application Priority Data

Oct. 14, 2010 (JP) ..... 2010-231929

(51) Int. Cl.
*F25B 49/00* (2006.01)
*F25B 49/02* (2006.01)
(Continued)

(52) U.S. Cl.
CPC ..... *F25B 49/02* (2013.01); *F24F 11/008* (2013.01); *F25B 25/005* (2013.01);
(Continued)

(58) Field of Classification Search
CPC ..... F25B 2700/171; F25B 2700/19; F25B 2700/193; F25B 2700/191;
(Continued)

(56) References Cited

U.S. PATENT DOCUMENTS 3,707,851 A * 1/1973 McAshan, Jr. ..... F25B 49/005 165/11.1
4,574,870 A * 3/1986 Weitman ..... F28D 21/0012 165/292
(Continued)

FOREIGN PATENT DOCUMENTS

JP 62-46161 A 2/1987
JP 04-131645 A 5/1992
(Continued)

OTHER PUBLICATIONS

Jiro, JP2007255818TRANS (English Translation), Oct. 2007.*
(Continued)

*Primary Examiner* — Justin Jonaitis
*Assistant Examiner* — Eric Ruppert
(74) *Attorney, Agent, or Firm* — Posz Law Group, PLC

(57) ABSTRACT

A refrigeration cycle apparatus includes low-pressure side pressure detecting means for detecting the pressure of a refrigerant being sucked by a compressor, suction refrigerant temperature detecting means for detecting the temperature of the refrigerant being sucked by the compressor, frequency detecting means for detecting the operation frequency of the compressor, cooling target fluid inflow temperature detecting means for detecting the temperature of a cooling target fluid flowing in an evaporator, cooling target fluid outflow temperature detecting means for detecting the temperature of the cooling target fluid flowing out of the evaporator, and flow rate calculating means (measuring unit, computing unit, and storage unit) for calculating the absolute quantity of the flow rate of the cooling target fluid flowing in the evaporator using a value detected by each detecting means.

13 Claims, 6 Drawing Sheets

(51) Int. Cl.
*F24F 11/00* (2006.01)
*F25B 25/00* (2006.01)

(52) U.S. Cl.
CPC ..... *F25B 49/005* (2013.01); *F24F 2011/0045* (2013.01); *F25B 2500/19* (2013.01); *F25B 2600/21* (2013.01); *F25B 2700/171* (2013.01); *F25B 2700/1933* (2013.01); *F25B 2700/21151* (2013.01); *F25B 2700/21172* (2013.01); *F25B 2700/21173* (2013.01); *F25B 2700/21174* (2013.01); *F25D 2500/04* (2013.01)

(58) Field of Classification Search
CPC ..... F25B 2700/195; F25B 2700/197; F25B 2700/21; F25B 2700/2102; F25B 2700/2013; F25B 2700/2106; F25B 2700/2116; F25B 2700/2117
USPC ..... 62/125, 126, 127, 128, 129, 130
See application file for complete search history.

(56) References Cited

U.S. PATENT DOCUMENTS 4,611,470 A * 9/1986 Enstrom ..... F25B 49/02 62/127
4,677,830 A * 7/1987 Sumikawa ..... B60H 1/3225 62/126
5,079,930 A * 1/1992 Beaverson ..... F25B 40/02 62/129
5,083,438 A * 1/1992 McMullin ..... G01L 3/26 165/11.1
5,363,905 A * 11/1994 Rhiel ..... B01D 3/4283 137/486
6,272,868 B1 * 8/2001 Grabon ..... F28B 11/00 165/11.1
6,330,802 B1 * 12/2001 Cummings ..... B60H 1/00978 62/126
6,658,373 B2 * 12/2003 Rossi ..... F24F 11/0086 62/125
7,201,006 B2 * 4/2007 Kates ..... F24F 3/1603 165/11.1
2004/0144106 A1 * 7/2004 Douglas ..... F25B 49/02 62/127
2005/0166608 A1 * 8/2005 Thybo ..... F25D 29/008 62/125
2006/0144059 A1 * 7/2006 Kang ..... F25B 49/005 62/129
2008/0006044 A1 * 1/2008 Tan ..... F25B 41/04 62/197

FOREIGN PATENT DOCUMENTS

JP 07117269 * 12/1995
JP 3083930 B2 9/2000
JP 2001-033069 A 2/2001
JP 3253190 B2 2/2002
JP 2007-255818 A 10/2007
JP 2007255818 * 10/2007
JP 2009-243828 A 10/2009
JP 2010-127568 A 6/2010

OTHER PUBLICATIONS

Masahiro, JP07117269TRANS (English Translation), Dec. 1995.*
International Search Report of the International Searching Authority dated Jan. 17, 2012 for the corresponding international application No. PCT/JP2011/005597 (with English translation).
Extended European Search Report dated Mar. 21, 2017 in the corresponding European patent application No. 11832265.0.

* cited by examiner

REFRIGERATION CYCLE APPARATUS

CROSS REFERENCE TO RELATED APPLICATIONS

This application is a U.S. national stage application of PCT/JP2011/005597 filed on Oct. 4, 2011, and claims priority to, and incorporates by reference, Japanese Patent Application No. 2010-231929 filed on Oct. 14, 2010.

TECHNICAL FIELD

The present invention relates to a refrigeration cycle apparatus that supplies a cooling target fluid cooled to an intended temperature.

BACKGROUND ART

A traditional refrigeration cycle apparatus that supplies a cooling target fluid cooled to an intended temperature directly measures the flow rate of the cooling target fluid using a flowmeter or other measuring instruments. Such a refrigeration cycle apparatus detects a flow-rate fault of the cooling target fluid or other faults caused by freezing or the like using the directly measured flow rate of the cooling target fluid. Thus such a refrigeration cycle apparatus needs to include the measuring instrument (flowmeter or the like) for directly measuring the flow rate of the cooling target fluid. This raises a problem that the refrigeration cycle apparatus is expensive.

To address this, refrigeration cycle apparatuses that aim to detect a flow rate or a flow-rate fault of a cooling target fluid without including a flowmeter have been proposed.

One example of the proposed traditional refrigeration cycle apparatuses aiming to detect the flow-rate fault of the cooling target fluid without including the flowmeter is "a cooling apparatus 100 that includes refrigeration cycle means including a compressor 1, a condenser 2, throttle means 4, and an evaporator 5, the cooling apparatus 100 including an air-sending device 3 for blowing air to the condenser 2, low-pressure refrigerant liquid temperature detecting means 10 for detecting a temperature of a low-pressure refrigerant liquid flowing in the evaporator 5, cooling target fluid inflow temperature detecting means 11 for detecting a cooling target fluid flowing in the evaporator 5, a computing unit 21 receiving a temperature of a detected value, a determining unit 23 determining 'the presence or absence of freezing of the cooling target fluid' or 'the possibility of freezing,' and a control unit 24 controlling the compressor 1, the air-sending device 3, the throttle means 4, and a pump 6 to prevent freezing of the cooling target fluid on the basis of a result of determination by the determining unit 23" (see, for example, Patent Literature 1).

One example traditional refrigeration cycle apparatus that aims to detect a flow rate of a cooling target fluid without including a flowmeter is one in which the flow rate of coolant water is estimated on the basis of measured data on a flow rate of cold water flowing in an evaporator, a temperature of the cold water at an entrance, a temperature of the cold water at an exit, an intermediate temperature of coolant flowing from an absorber to a condenser, and a temperature of the coolant flowing in the absorber at the entrance (see, for example, Patent Literature 2).

Another example traditional refrigeration cycle apparatus that aims to detect a flow rate of a cooling target fluid without including a flowmeter is one in which a refrigeration load is calculated from measured data on a flow rate of cold water flowing in an evaporator, a temperature of the cold water at an entrance, and a temperature of the cold water at an exit, the ratio between the amount Qa of heat received from the cold water and the amount Qe of heat transferred to the coolant (heat exchange coefficient K) is calculated on the basis of the temperature of the coolant and the refrigeration load, and the flow rate of the coolant is calculated on basis of the calculated heat exchange coefficient K (see, for example, Patent Literature 3).

CITATION LIST

Patent Literature

Patent Literature 1: Japanese Unexamined Patent Application Publication No. 2009-243828

Patent Literature 2: Japanese Patent No. 3083930

Patent Literature 3: Japanese Patent No. 3253190

SUMMARY OF INVENTION

Technical Problem

Because the traditional refrigeration cycle apparatus aiming to detect a flow-rate fault without including a flowmeter determines a decrease in the flow rate using an index affected by an operating condition of the refrigeration cycle apparatus, there is a problem that the determination of the decrease in the flow rate is unstable.

The traditional refrigeration cycle apparatus aiming to detect a flow rate of a cooling target fluid without including a flowmeter has a problem that it can determine a relative decrease in the flow rate but cannot grasp the absolute quantity of the flow rate.

The present invention is directed to solve the above-described problems, and it is an object of the present invention to obtain a refrigeration cycle apparatus that can grasp the absolute quantity of a flow rate of a cooling target fluid flowing in an evaporator without including a measurement instrument, such as a flowmeter.

Solution to Problem

A refrigeration cycle apparatus according to the present invention includes a first circuit in which a compressor that compresses a refrigerant, a condenser that condenses the refrigerant compressed by the compressor, pressure-reducing means for reducing a pressure of the refrigerant condensed by the condenser, and an evaporator that causes the refrigerant with the pressure reduced by the pressure-reducing means to evaporate are connected by piping; and a second circuit in which the evaporator and cooling target fluid sending means for sending, to the evaporator, a cooling target fluid that exchanges heat with the refrigerant flowing in the evaporator are connected by piping. The refrigeration cycle apparatus further includes low-pressure side pressure detecting means for detecting the pressure of the refrigerant being sucked by the compressor; suction refrigerant temperature detecting means for detecting a temperature of the refrigerant being sucked by the compressor; frequency detecting means for detecting an operation frequency of the compressor; cooling target fluid inflow temperature detecting means for detecting a cooling target fluid inflow temperature, the cooling target fluid temperature being a temperature of the cooling target fluid flowing in the evaporator; and cooling target fluid outflow temperature detecting means for detecting a cooling target fluid outflow temperature, the cooling target fluid outflow temperature being a temperature of the cooling target fluid flowing out of the evaporator. The refrigeration cycle apparatus further includes flow rate calculating means for calculating an absolute quantity of a flow rate of the cooling target fluid flowing in the evaporator using a value detected by each of the low-pressure side pressure detecting means, the suction refrigerant temperature detecting means, the frequency detecting means, the cooling target fluid inflow temperature detecting means, and the cooling target fluid outflow temperature detecting means.

Advantageous Effects of Invention

In the present invention, the absolute quantity of the flow rate of the cooling target fluid flowing in the evaporator is calculated using the values detected by the low-pressure side pressure detecting means, the suction refrigerant temperature detecting means, the frequency detecting means, the cooling target fluid inflow temperature detecting means, and the cooling target fluid outflow temperature detecting means. The use of these detected values enables the absolute quantity of the flow rate of the cooling target fluid flowing in the evaporator to be calculated employing some methods, for example, as illustrated in Embodiments below. Thus the refrigeration cycle apparatus according to the present invention can grasp the absolute quantity of the flow rate of the cooling target fluid flowing in the evaporator without including a measurement instrument, such as a flowmeter.

DESCRIPTION OF EMBODIMENTS

Embodiment 1

<<Device Configuration>>

Figure 1:
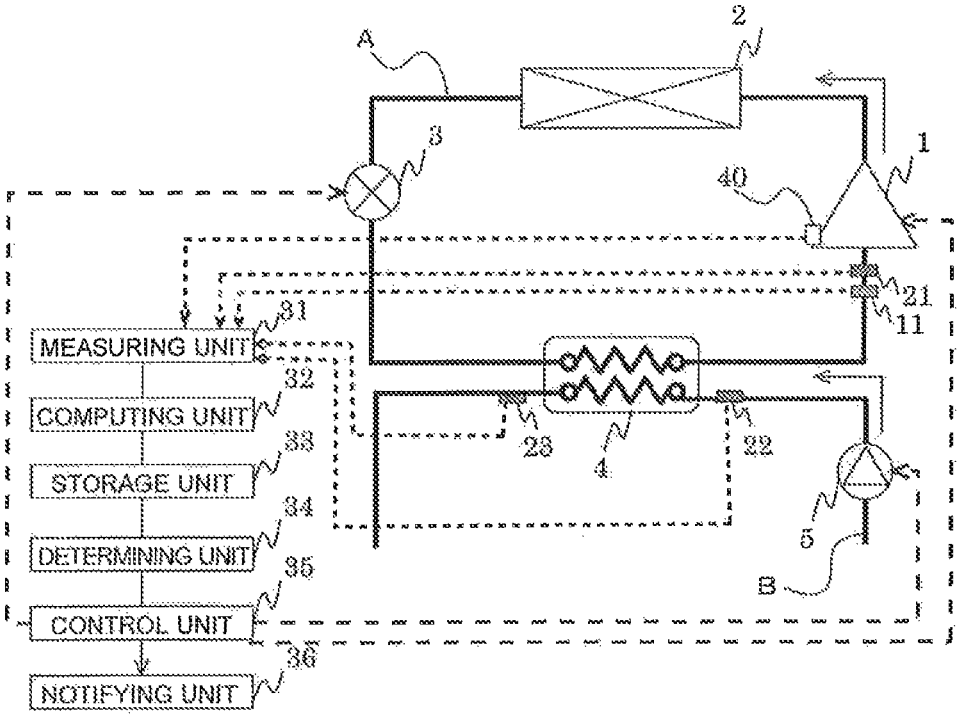
FIG. 1 is a diagram of a refrigerant circuit and system line in a refrigeration cycle apparatus according to Embodiment 1 of the present invention.

The configuration of a refrigeration cycle apparatus according to Embodiment 1 of the present invention is described on the basis of FIG. 1.

FIG. 1 is a diagram of the refrigerant circuit and system line in the refrigeration cycle apparatus according to Embodiment 1 of the present invention.

A refrigeration cycle apparatus 100 according to Embodiment 1 includes a first circuit A in which a refrigerant circulates and a second circuit B configured such that a cooling target fluid cooled by this refrigerant circulates. The first circuit A is one in which a compressor 1, a condenser 2, pressure-reducing means 3, and an evaporator 4 are sequentially connected by piping. The second circuit B is a circuit that connects the evaporator 4 and a cooling load, such as a refrigerator or an indoor unit (not illustrated). The second circuit B is connected to cooling target fluid sending means 5 for circulating the cooling target fluid through the second circuit B.

(Compressor)

The compressor 1 is a compressor that can change its operation capacitance. One example of the compressor 1 can be a positive-displacement compressor driven by a motor controlled by an inverter, for example. In place of the single compressor 1 illustrated in FIG. 1, two or more compressors connected in parallel or in series may be used.

(Condenser)

The condenser 2 is a heat exchanger in which a refrigerant and a heat exchange medium exchange heat with each other (more specifically, a refrigerant is cooled by a heat exchange medium). One example of the condenser 2 can be a plate-type heat exchanger in which the peripheral portions of a plurality of thin plates spaced away from each other are sealed and the spaces provided between the thin plates serve as alternately appearing two channels comprising refrigerant channels and channels for a heat exchange medium. The heat exchange medium in this case can be a fluid, such as water, for example, and is supplied to the condenser 2 by sending means (not illustrated), such as a pump.

The heat exchange medium, which is a target of heat exchange with the refrigerant, in the refrigeration cycle apparatus 100 according to Embodiment 1 is water. However, the refrigerant is not limited to water. Alternatively, brine in which an additive for lowering the freezing point is mixed may be used as the heat exchange medium. The condenser 2 is not limited to a plate-type heat exchanger, and it may also be another type of heat exchanger that performs the same function, such as a double-pipe heat exchanger in which heat is exchanged between the inside and the outside of one of two pipes or a cross-fin type fin-and-tube heat exchanger that includes a heat pipe and a plurality of fins. When the condenser 2 is a fin-and-tube heat exchanger, the heat exchange medium is air, and driving means, such as a fan, is used as means for sending the heat exchange medium. In place of the single condenser 2 illustrated in FIG. 1, two or more condensers connected in parallel or in series may be used.

(Pressure-Reducing Means)

The pressure-reducing means 3 adjusts the flow rate of the refrigerant passing through the first circuit A or the like. An electronic expansion valve in which the opening degree of the throttle can be adjusted by a stepping motor (not illustrated), a mechanical expansion valve that uses a diaphragm as a pressure receiving section, a capillary tube, or other components can be used as the pressure-reducing means 3. In place of the single pressure-reducing means 3 illustrated in FIG. 1, two or more pressure-reducing means connected in parallel or in series may be used.

(Evaporator)

The evaporator 4 is a heat exchanger in which a refrigerant and a heat exchange medium exchange heat with each other. One example of the evaporator 4 is a plate-type heat exchanger.

In place of the single evaporator 4 illustrated in FIG. 1, two or more evaporators connected in parallel or in series may be used.

(Cooling Target Fluid and Cooling Target Fluid Sending Means)

The cooling target fluid is a fluid, such as water. It may be simple water, brine in which an additive for lowering the freezing point is mixed, or other fluids. Because the cooling target fluid in Embodiment 1 is the above-described fluid, the cooling target fluid sending means 5 is fluid sending means, such as a pump. The cooling target fluid sending means 5 is not limited to this means, and it may be another type of sending means that performs the same function.

(Refrigerant)

Examples of the refrigerant used in the refrigeration cycle apparatus 100 (that is, the refrigerant circulating in the first circuit A) can include a HFC refrigerant, such as R410A, R407C, or R404A, a HCFC refrigerant, such as R22 or R134a, and a natural refrigerant, such as hydrocarbon or helium. The refrigerant used in the refrigeration cycle apparatus 100 is not limited to these refrigerants. Other refrigerants that perform the same refrigerant function may also be used.

The configuration of the first circuit A (refrigerant circuit) according to Embodiment 1 is not limited to the configuration illustrated in FIG. 1. A configuration other than that illustrated in FIG. 1 (for example, a four-way valve, an accumulator, a receiver, or the like) may be connected to the first circuit A.

(Temperature, Pressure, and Frequency Detecting System)

As illustrated in FIG. 1, the refrigeration cycle apparatus 100 includes suction refrigerant temperature detecting means 21 for detecting the temperature of a refrigerant being sucked by the compressor 1, cooling target fluid inflow temperature detecting means 22 for detecting the temperature of a cooling target fluid flowing in the evaporator 4, and cooling target fluid outflow temperature detecting means 23 for detecting the temperature of the cooling target fluid flowing out of the evaporator 4. The suction refrigerant temperature detecting means 21 is provided in the suction side of the compressor 1. The refrigeration cycle apparatus 100 further includes low-pressure side pressure detecting means 11 provided in the suction side of the compressor 1. The refrigeration cycle apparatus 100 also includes frequency detecting means 40 for detecting the operation frequency of the compressor 1.

By providing the suction refrigerant temperature detecting means 21 and low-pressure side pressure detecting means 11 in the suction side of the compressor 1, it is possible to detect the degree of superheat of a refrigerant being sucked by the compressor 1 (hereinafter referred to as the degree of superheat of compressor suction). Controlling the degree of superheat of compressor suction can achieve an operation in which a liquid refrigerant does not return to the compressor 1. The position of each of the suction refrigerant temperature detecting means 21 and low-pressure side pressure detecting means 11 is not limited to that illustrated in the drawing, and both may be in any position in the section from the evaporator 4 to the suction side of the compressor 1. Converting the pressure detected by the low-pressure side pressure detecting means 11 into saturation temperature enables the evaporating temperature of the refrigeration cycle to be determined.

Figure 2:
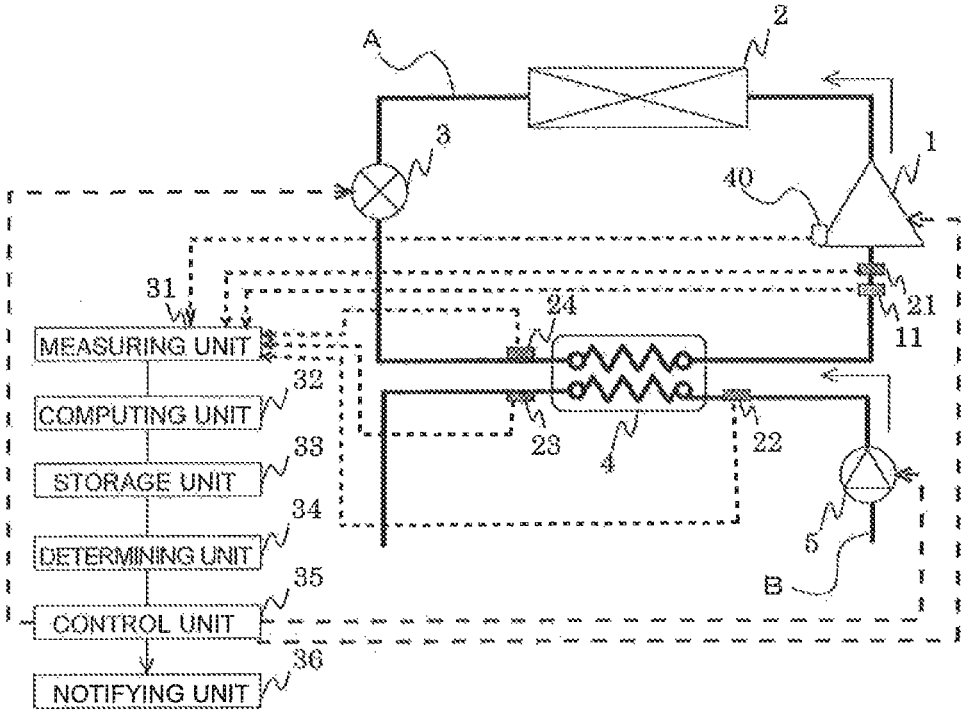
FIG. 2 is a diagram of a refrigerant circuit and system line in another example of the refrigeration cycle apparatus according to Embodiment 1 of the present invention.

The refrigeration cycle apparatus may be configured as illustrated in FIG. 2, and the evaporating temperature of the refrigeration cycle may be determined.

FIG. 2 is a diagram of a refrigerant circuit and system line in another example of the refrigeration cycle apparatus according to Embodiment 1 of the present invention. The refrigeration cycle apparatus 100 illustrated in FIG. 2 includes low-pressure refrigerant temperature detecting means 24 for detecting the temperature of a refrigerant flowing in the evaporator 4. The low-pressure refrigerant temperature detecting means 24 is provided in the entrance side of the evaporator 4, and its detected value is used as the evaporating temperature of the refrigeration cycle. When the evaporating temperature is determined using a value detected by the low-pressure side pressure detecting means 11, a pressure loss occurring in a connection pipe extending from the exit of the evaporator 4 to the suction side of the compressor 1 causes an error between the calculated evaporating temperature and an actual evaporating temperature. However, by providing the low-pressure refrigerant temperature detecting means 24 in the entrance side of the evaporator 4, as illustrated in FIG. 2, it is possible to eliminate an error occurring in the calculation of the evaporating temperature using the low-pressure side pressure detecting means 11, and thus the evaporating temperature can be determined with high precision.

(Control System)

A value detected by each of the low-pressure side pressure detecting means 11, suction refrigerant temperature detecting means 21, cooling target fluid inflow temperature detecting means 22, cooling target fluid outflow temperature detecting means 23, and frequency detecting means 40 is input into a measuring unit 31. The detected values input to the measuring unit 31 are input into a computing unit 32. The computing unit 32 performs a computation on each of the detected values using a given expression or the like, and the results of the computations are input into a storage unit 33 and stored therein. The storage unit 33 can store the results from the computing unit 32, a given constant, an approximate expression and a table for use in calculating a refrigerant physical property value (saturation pressure, saturation temperature, enthalpy, or other values), a formula for use in computation, specifications of each device included in the refrigeration cycle apparatus 100, standard operational data, and other information. The storage unit 33 can refer to and rewrite the content of the above-described stored information as needed.

A determining unit 34 compares the above-described computational results stored in the storage unit 33 with a flow-rate fault determining criterion value, determines "the presence or absence of a flow-rate fault" of the cooling target fluid, and inputs the result of the determination into a control unit 35. The control unit 35 controls at least one of the compressor 1, pressure-reducing means 3, and cooling target fluid sending means 5 (for example, stops an operation or reduces the speed of the compressor 1) on the basis of the result of the determination by the determining unit 34. When a flow-rate fault occurs, an alert is issued by a notifying unit 36. That is, the control unit 35 corresponds to control means in the present invention, and the notifying unit 36 corresponds to notifying means in the present invention.

Processing in the measuring unit 31, computing unit 32, determining unit 34, and control unit 35 is performed by a microprocessor. The storage unit 33 can be made of semiconductor memory, for example. The notifying unit 36 can display a result of processing by the microprocessor using a light-emitting device (LED), a monitor, or other devices, can output an alarm sound or other sounds, and can output information to a remote place using communication means (not illustrated), such as a phone line, a local area network (LAN) line, or radio equipment.

The above-described measuring unit 31, computing unit 32, storage unit 33, determining unit 34, and control unit 35 in the above-described configuration example are incorporated in the refrigeration cycle apparatus. Alternatively, they may be disposed outside the refrigeration cycle apparatus or the like.

<<Operational Behavior of Refrigeration Cycle Apparatus>>

Then, an operational behavior of the refrigeration cycle apparatus 100 according to Embodiment 1 is described on the basis of FIG. 1. A high-temperature, high-pressure gas refrigerant discharged from the compressor 1 reaches the condenser 2, and it is condensed and liquefied by a heat exchange action with the heat exchange medium. The condensed and liquefied refrigerant becomes a decompressed two-phase refrigerant in the pressure-reducing means 3, and the two-phase refrigerant is sent to the evaporator 4. The two-phase refrigerant flowing in the evaporator 4 is made to evaporate by a heat exchange action with the cooling target fluid supplied from the cooling target fluid sending means 5, and it becomes a low-pressure gas refrigerant. Here, the pressure-reducing means 3 controls the flow rate of the refrigerant flowing in the evaporator 4 such that the degree of superheat of compressor suction of the refrigerant on the suction side of the compressor 1 is equal to a predetermined value. Thus the gas refrigerant at the exit of the evaporator 4 is in a state where it has a predetermined degree of superheat. The gas refrigerant produced by the gasification in the evaporator 4 returns to the compressor 1. The degree of superheat of compressor suction can be determined by subtracting the evaporating temperature from a value detected by the suction refrigerant temperature detecting means 21. The evaporating temperature can be determined by conversion of the pressure detected by the low-pressure side pressure detecting means 11 into saturation temperature.

The cooling target fluid cooled in the evaporator 4 is guided to a required cooling load. Here, the flow rate of the refrigerant flowing in the evaporator 4 complies with the request for the cooling load and is controlled so as to be within the range where the cooling target fluid does not freeze. This control of the flow rate of the refrigerant flowing in the evaporator 4 is conducted by control of the operation capacitance of the compressor 1 by the control unit 35.

Figure 3:
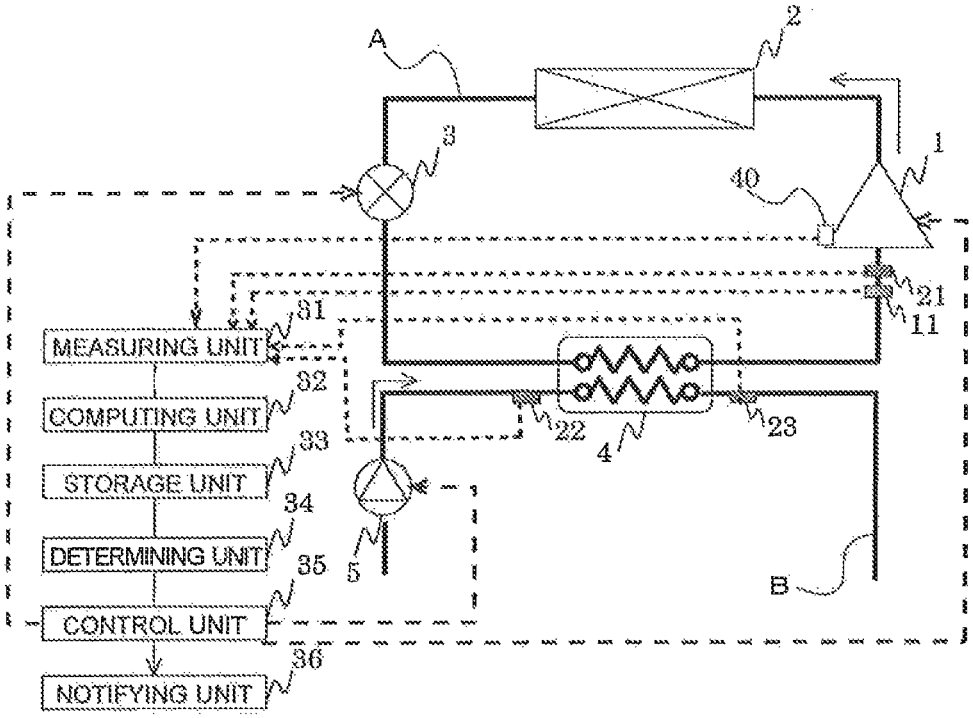
FIG. 3 is a diagram of a refrigerant circuit and system line in still another example of the refrigeration cycle apparatus according to Embodiment 1 of the present invention.

The system configuration of the refrigeration cycle apparatus 100 according to Embodiment 1 is not limited to that illustrated in FIG. 1, and it may be the system configuration illustrated in FIG. 3. That is, the refrigeration cycle apparatus 100 illustrated in FIG. 1 has the form in which the refrigerant and cooling target fluid exchanging heat with each other within the evaporator 4 flow in opposite directions. The refrigeration cycle apparatus 100 is not limited to this and may have the form in which the refrigerant and cooling target fluid exchanging heat with each other within the evaporator 4 flow in the same direction, as in the refrigeration cycle apparatus 100 illustrated in FIG. 3.

<<Method of Determining Whether Flow-Rate Fault of Cooling Target Fluid Occurs (Flowchart)>>

Next, a method of determining whether a flow-rate fault of a cooling target fluid occurs according to Embodiment 1 is described.

Figure 6:
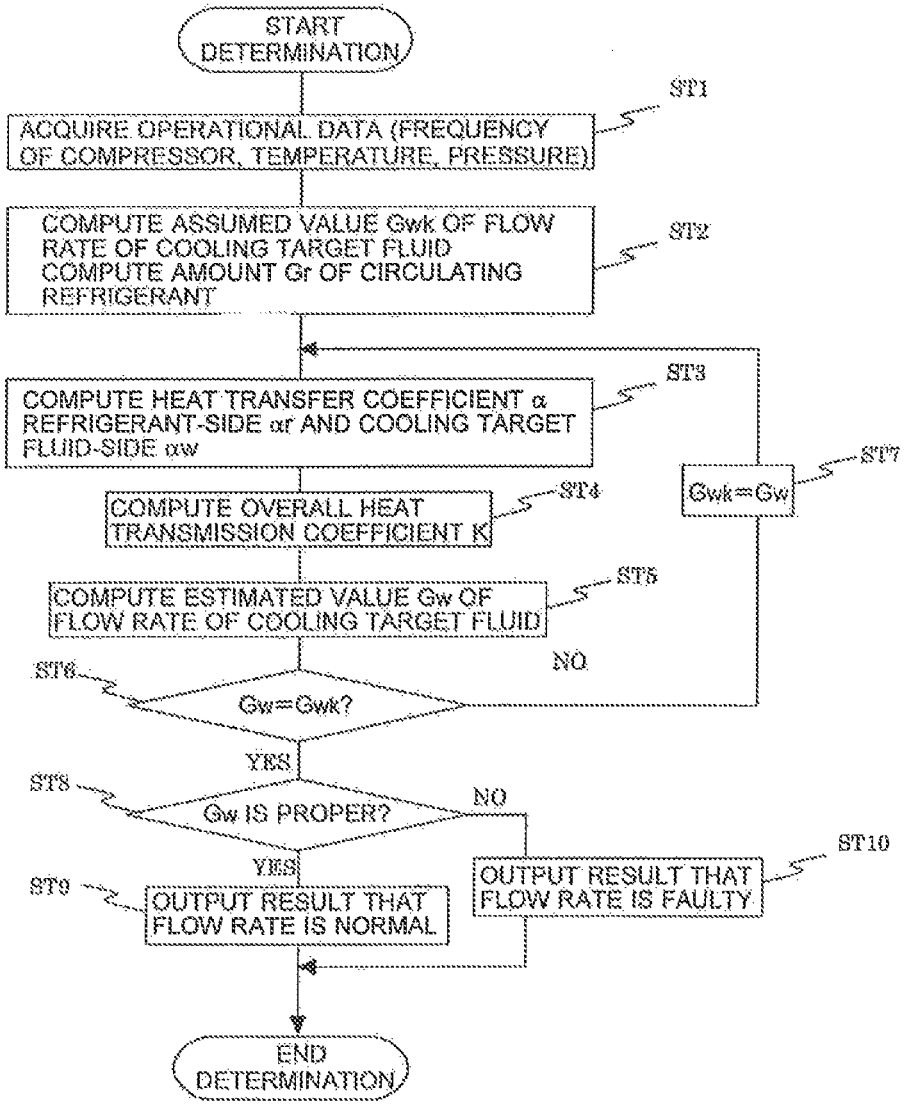
FIG. 6 is a flowchart that illustrates how a flow-rate fault of a cooling target fluid is determined in Embodiment 1 of the present invention.

FIG. 6 is a flowchart that illustrates how a flow-rate fault of a cooling target fluid is determined in Embodiment 1 of the present invention. The method of determining whether the flow-rate fault of the cooling target fluid occurs in Embodiment 1 is described below using FIGS. 6 and 1.

When determination of whether a flow-rate fault of a cooling target fluid occurs starts, the measuring unit 31 acquires values detected by the low-pressure side pressure detecting means 11, suction refrigerant temperature detecting means 21, cooling target fluid inflow temperature detecting means 22, cooling target fluid outflow temperature detecting means 23, and frequency detecting means 40 (pressure, temperature, operation frequency of the compressor 1: that is, operational data) in ST1.

In ST2, the computing unit 32 computes the amount $G_r$ of the circulating refrigerant and an assumed value $G_{wk}$ of the flow rate of the cooling target fluid using the detected values acquired in ST1.

The amount $G_r$ of the circulating refrigerant can be computed by using Expression (1) below using the displacement $V_{st}$ of the compressor 1 [$m^3$], the operation frequency F of the compressor 1 [Hz], the density $\rho_s$ of the refrigerant sucked by the compressor 1 [$kg/m^3$], and the volumetric efficiency $\eta_v$ [–]. The density $\rho_s$ of the refrigerant sucked by the compressor 1 can be computed from a value detected by each of the low-pressure side pressure detecting means 11 and suction refrigerant temperature detecting means 21. The displacement $V_{st}$ of the compressor 1 is a value determined by the specifications of the compressor 1 and is stored in the storage unit 33. The volumetric efficiency $\eta_v$ is a value of approximately 0.9 to 1.0. The volumetric efficiency $\eta_v$ can be previously stored in the storage unit 33 and be used by a method of being given as a constant, for example.

[Math. 1]

$$G_r = V_{st} \times F \times \rho_s \times \eta_v \tag{1}$$

Characteristics between the amount $G_r$ of the circulating refrigerant and the performance characteristic of the compressor 1 may be determined by actual measurement, simulation, or the like, and the amount $G_r$ of the circulating refrigerant may be determined using a table, an approximate expression, or the like created on the basis of the determined results on the characteristics. In this case, because the performance characteristic of the compressor 1 depends on the operation frequency of the compressor 1, the degree of superheat of compressor suction, the condensing temperature, and the evaporating temperature (that is, because the performance value of the compressor 1 can be calculated from the operation frequency of the compressor 1, the degree of superheat of compressor suction, the condensing temperature, and the evaporating temperature), the operation frequency of the compressor 1, the degree of superheat of compressor suction, the condensing temperature, and the evaporating temperature can be used as parameters used in the table, approximate expression, or the like for use in determining the amount $G_r$ of the circulating refrigerant. When the amount $G_r$ of the circulating refrigerant is determined using the condensing temperature, for example, the refrigeration cycle apparatus 100 may have the configuration illustrated in FIG. 4 or 5. That is, as illustrated in FIG. 4, the refrigeration cycle apparatus 100 may include high-pressure side pressure detecting means 12 for measuring the pressure of the refrigerant flowing in the condenser 2, and the condensing temperature may be determined by conversion of a pressure value detected by the high-pressure side pressure detecting means 12 into saturation temperature.

Figure 5:
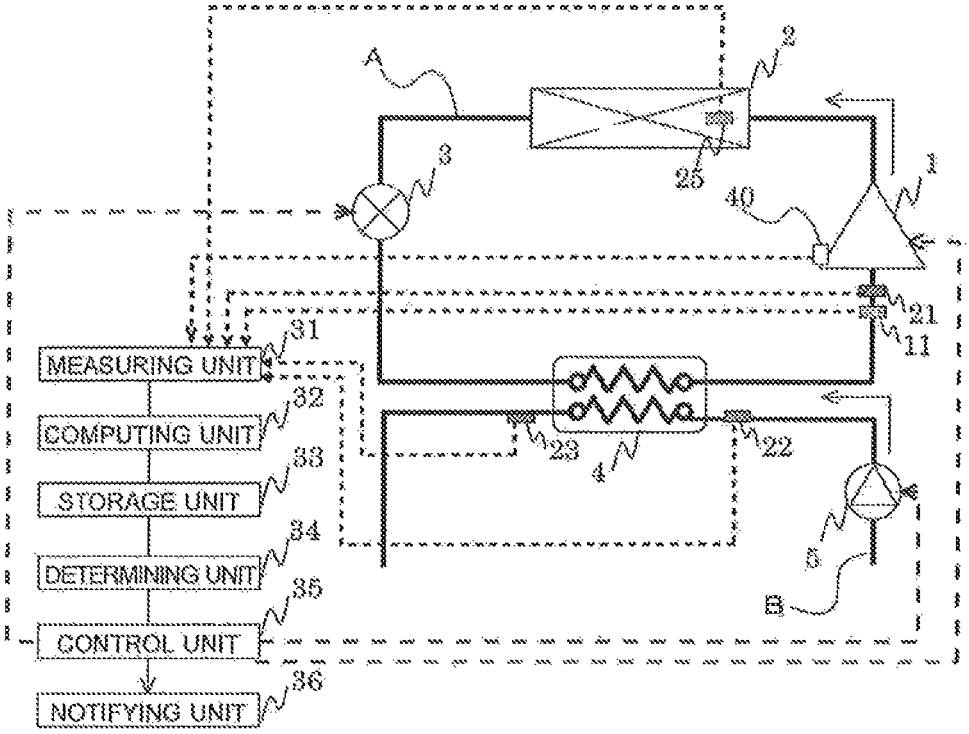
FIG. 5 is a diagram of a refrigerant circuit and system line in yet further example of the refrigeration cycle apparatus according to Embodiment 1 of the present invention.

Alternatively, as illustrated in FIG. 5, the refrigeration cycle apparatus 100 may include high-pressure refrigerant temperature detecting means 25 for measuring the temperature of the refrigerant flowing in the condenser 2, and a temperature value detected by the high-pressure refrigerant temperature detecting means 25 may be determined as the condensing temperature. As for the condensing temperature and evaporating temperature used as parameters used in the table, approximate expression, or the like for use in calculating the amount of the circulating refrigerant, in place of the evaporating temperature, a pressure value detected by the low-pressure side pressure detecting means 11 itself may be used as a parameter, and in place of the condensing temperature, a pressure value detected by the high-pressure side pressure detecting means 12 itself may be used as a parameter.

Figure 4:
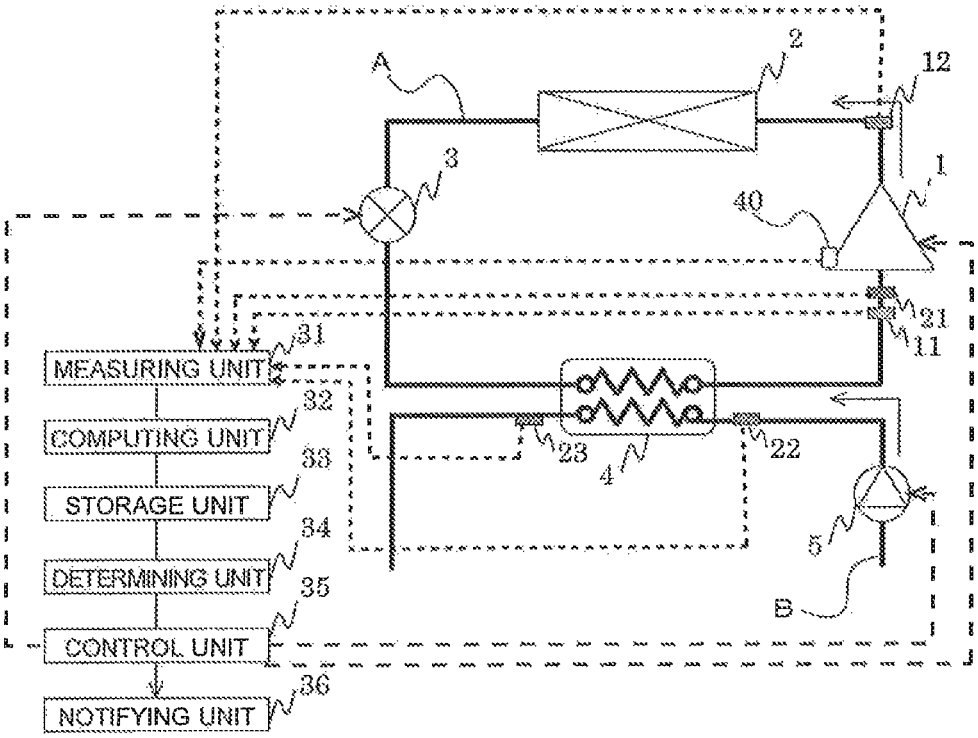
FIG. 4 is a diagram of a refrigerant circuit and system line in yet another example of the refrigeration cycle apparatus according to Embodiment 1 of the present invention.

The position of each of the high-pressure side pressure detecting means 12 and the high-pressure refrigerant temperature detecting means 25 is not limited to the positions illustrated in FIGS. 4 and 5. Both may be positioned in any position in the section from the discharge side of the compressor 1 to the condenser 2. The high-pressure refrigerant temperature detecting means 25 may be disposed in a refrigerant pipe inside the condenser or provided in the entrance or exit side of the condenser 2.

The assumed value $G_{wk}$ of the flow rate of the cooling target fluid can be determined from the following Expression (2) using the amount $G_r$ of the circulating refrigerant determined in the above-described manner and the operational data acquired in ST1.

[Math. 2]

$$G_{wk} = \frac{G_r \times \Delta H^*_{eva}}{\rho_w \times C_{pw} \times (T_{wi} - T_{wo})} \tag{2}$$

$T_{wi}$: cooling target fluid inflow temperature [° C.]

$T_{wo}$: cooling target fluid outflow temperature [° C.]

$\rho_w$: density of cooling target fluid [kg/m$^3$]

$C_{pw}$: specific heat at constant pressure of cooling target fluid [kJ/kg·K]

$\Delta H_{eva}$*: enthalpy difference of refrigerant between entrance and exit of evaporator 4 [kJ/kg]

The density $\rho_w$ of the refrigerant and the specific heat $C_{pw}$ at constant pressure of the cooling target fluid can be determined from an approximate expression for physical properties or the like using a temperature of the cooling target fluid (a cooling target fluid inflow temperature detected by the cooling target fluid inflow temperature detecting means 22 or a cooling target fluid outflow temperature detected by the cooling target fluid outflow temperature detecting means 23). The enthalpy difference $\Delta H_{eva}$* of the refrigerant between the entrance and exit of evaporator 4 [kJ/kg] is given by a method, such as, previously storing it in the storage unit 33 as standard operational data for the refrigeration cycle apparatus 100 and referring to the stored data in the storage unit 33. Here, $G_r \times \Delta H_{eva}$* in the numerator in Expression (2) represents the cooling capacity (evaporation capacity) $Q_e$ of the evaporator 4. That is, $Q_e = G_r \times \Delta H_{eva}$*. Thus the cooling capacity $Q_e$ may be stored in the storage unit 33 as the performance characteristic or the like using a table, an approximate expression, or the like, and the cooling capacity $Q_e$ may be determined using the table, approximate expression, or the like. As described above, because the performance characteristic of the compressor 1 depends on the operation frequency of the compressor 1, the degree of superheat of compressor suction, the condensing temperature, and the evaporating temperature (that is, the performance characteristic of the compressor 1 can be calculated from the operation frequency of the compressor 1, the degree of superheat of compressor suction, the condensing temperature, and the evaporating temperature), the operation frequency of the compressor 1, the degree of superheat of compressor suction, the condensing temperature, and the evaporating temperature can be used as parameters used in the table, approximate expression, or the like. The method of determining the cooling capacity $Q_e$ is not limited to the above method. It may be a method of storing the cooling capacity $Q_e$ as a constant in the storage unit 33 and other methods. The method of setting the assumed value $G_{wk}$ of the flow rate of the cooling target fluid is not limited to the above method. For example, a set flow rate value upon usage of the refrigeration cycle apparatus 100 stored in the storage unit 33 may be given as $G_{wk}$. Alternatively, for example, the overall heat transmission coefficient K, which is described below, may be initialized, the flow rate $G_w$ of the cooling target fluid may be determined using the following Expression (7), and that value may be determined as the assumed value $G_{wk}$ of the flow rate of the cooling target fluid.

In ST3, to determine the heat transmission characteristic, the computing unit 32 computes the refrigerant-side heat transfer coefficient $\alpha_r$ [kW/(m$^2$·K)] and the cooling target fluid-side heat transfer coefficient $\alpha_w$ [kW/(m$^2$·K)]. The refrigerant-side heat transfer coefficient $\alpha_r$ can be determined from the function expression expressed in the following Expression (3) using the amount $G_r$ of the circulating refrigerant. The cooling target fluid-side heat transfer coefficient $\alpha_w$ can be determined from the function expression expressed in the following Expression (4) using the flow rate $G_{wk}$ of the cooling target fluid.

[Math. 3]

$$\alpha_r = \beta_r \times G_r^{\gamma_r} \tag{3}$$

[Math. 4]

$$\alpha_w = \beta_w \times G_{wk}^{\gamma_w} \tag{4}$$

The proportionality factors $\beta_r$ and $\beta_w$ and power factors $\gamma_r$ and $\gamma_w$ are previously determined from actual measurement data, simulation data, a theoretical equation of heat transfer, or the like, and they are previously given in Expression (3) or (4) as a constant (alternatively, are stored in the storage unit 33 independently of Expressions (3) and (4)).

In ST4, the computing unit 32 computes the overall heat transmission coefficient K from the following Expression (5) using the refrigerant-side heat transfer coefficient $\alpha_r$ and cooling target fluid-side heat transfer coefficient $\alpha_w$ computed in ST3.

[Math. 5]

$$K = \frac{1}{\frac{1}{\alpha_r} + \frac{1}{\alpha_w}} \tag{5}$$

The above Expression (5) is the one in which the term of the thermal conductivity resistance is omitted from the defining expression of the overall heat transmission coefficient K. It is, of course, to be noted that the defining expression of the overall heat transmission coefficient K indicated in the following Expression (6) may be used.

[Math. 6]

$$K = \frac{1}{\frac{1}{\alpha_r} + \frac{\delta}{\lambda} + \frac{1}{\alpha_w}} \tag{6}$$

δ: thickness of heat transfer wall [m]

λ: thermal conductivity of heat transfer wall [kW/(m$^2$·K)]

In ST5, the computing unit 32 computes the flow rate $G_w$ of the cooling target fluid using the overall heat transmission coefficient K determined in ST4 and the operational data acquired in ST1. The flow rate $G_w$ can be expressed as the following Expression (7) using the overall heat transmission coefficient K.

[Math. 7]

$$G_w = \frac{A \times K \times 3600}{\rho_w \times C_{pw} \times \ln\left(\frac{T_{wi} - ET}{T_{wo} - ET}\right)} \tag{7}$$

ET: evaporating temperature [° C.]

A: heat transfer area of evaporator [m$^2$]

That is, the measuring unit 31, the computing unit 32, and the storage unit 33 correspond to flow rate calculating means (means for calculating the absolute quantity of the flow rate of the cooling target fluid) in the present invention.

In ST6, the determining unit 34 determines "whether the flow rate $Q_w$ of the cooling target fluid computed in ST5 is within a predetermined range (for example, ±1% or the like) from the assumed value $G_{wk}$ of the flow rate of the cooling target fluid computed in ST2." When the result of determination is YES, processing proceeds to ST8. When the result of determination is NO, processing proceeds to ST7, where $G_{wk}$ is replaced with $G_w$, and the operation beginning from ST3 repeats.

ST6, which is an optional step, enables the overall heat transmission coefficient K to be determined with higher precision, and makes it possible to cause the flow rate $G_w$ of the cooling target fluid to more closely approach an actual flow rate. When ST6 is performed, the determining unit 34 also corresponds to flow rate calculating means (means for calculating the absolute quantity of the flow rate of the cooling target fluid) in the present invention.

In ST8, the determining unit 34 determines "whether the flow rate $G_w$ of the cooling target fluid in which the result of determination in ST6 is YES is a proper flow rate." For example, the flow-rate fault determining criterion value $G_{wb}$ is previously set as 50% of the flow-rate lower limit when the refrigeration cycle apparatus 100 operates (is stored in the storage unit 33), and the determining condition in ST8 is "$G_w > G_{wb}$." When the result of determination is YES, processing proceeds to ST9. When the result of determination is NO, processing proceeds to ST10. In ST9, the result that the water flow rate is normal is output, and the determination of the occurrence of a flow-rate fault of the cooling target fluid ends. In ST10, the result that the water flow rate is faulty is output, and the determination ends.

That is, the storage unit 33 and determining unit 34 correspond to flow-rate fault determining means in the present invention.

In Embodiment 1, the flow-rate fault determining criterion value $G_{wb}$ is 50% of the lower limit of the flow rate when the refrigeration cycle apparatus 100 operates. The flow-rate fault determining criterion value $G_{wb}$ is not limited to this value. The threshold of the criterion value may vary depending on the operational status of the refrigeration cycle apparatus 100. For example, the flow-rate fault determining criterion value $G_{wb}$ may be 80% of the lower limit.

When the result that the flow rate is faulty is output in ST10 and the determination ends, the control unit 35 may perform operational control as a protective control behavior on the basis of this determination, in which the flow rate is faulty. Examples of the operational control can include an immediate halt of the operation of the compressor 1, prohibition of acceleration, and reducing the frequency of the compressor by several hertz for every several seconds. In control on the refrigeration cycle apparatus 100, the protective control behavior may be a single setting (a setting at which one of the above-described examples of the operational control is executed) or a combination setting (a setting at which a plurality of the above-described examples of the operational control are executed). When the protective control behavior is the combination setting, for example, the threshold of each operational control may be set depending on the flow rate $G_w$ of the cooling target fluid, and each operational control may be executed in stages in accordance with the degree of a reduction in the flow rate. Executing each operational control serving as the protective control behavior in such a cooperative manner as stated above can more reliably prevent a failure of the compressor 1 or the like caused by a flow-rate fault of the cooling target fluid.

The outputting method in the case where the result of determination is that the flow rate is normal can be displaying it in an output terminal arranged on the substrate of the notifying unit 36 (LED, liquid crystal, or the like), outputting communication data to a remote place, or the like. When communication data is output to a remote place, a component that outputs and displays it may also constitute notifying means, together with the notifying unit 36.

The outputting method in the case where the result of determination is that the flow rate is faulty (is not normal) can also be displaying it in an output terminal arranged on the substrate of the notifying unit 36 (LED, liquid crystal, or the like), outputting communication data to a remote place, or the like, as in the case where the result of determination is that the flow rate is normal. When the result of determination is that the flow rate is faulty, because of urgent necessity, a method of directly outputting the occurrence of a fault to a serviceperson over the telephone or the like to notify it may also be used.

In addition to the notification of the result of determination that the flow rate is normal or faulty, the value of the flow rate $G_w$ of the cooling target fluid computed using the above expression may also be displayed in an output terminal arranged on the substrate of the notifying unit 36 (LED, liquid crystal, or the like) or be output as communication data to a remote place.

Outputting and displaying the result of determination that the flow rate is normal and faulty and flow rate $G_w$ of the cooling target fluid as described above enables the operational state of the refrigeration cycle apparatus 100 to be clearly shown to a user or an administrator of the refrigeration cycle apparatus 100, and facilitates maintenance management, and the like of the refrigeration cycle apparatus 100.

As described above, the refrigeration cycle apparatus 100 having the above configuration can calculate the flow rate $G_w$ of the cooling target fluid flowing in the evaporator 4 (that is, the absolute quantity of the flow rate of the cooling target fluid) with high precision using a value detected by each detecting means in the refrigeration cycle apparatus 100. For example, by calculating the refrigerant-side heat transfer coefficient $\alpha_r$ and cooling target fluid-side heat transfer coefficient $\alpha_w$ using a value detected by each detecting means, calculating the overall heat transmission coefficient K using the calculated values and the value detected by each detecting means, and calculating the absolute quantity of the flow rate of the cooling target fluid flowing in the evaporator 4 using the overall heat transmission coefficient K and the value detected by each detecting means, the refrigeration cycle apparatus 100 can calculate the flow rate $G_w$ of the cooling target fluid flowing in the evaporator 4 (that is, the absolute quantity of the flow rate of the cooling target fluid) with high precision without being affected by a change in the operational state (one such change may be increase or decrease in the amount of circulating refrigerant, or increase or decrease in the cooling target fluid) of the refrigeration cycle apparatus 100.

It is not necessary for the refrigeration cycle apparatus 100 having the above-described configuration to include a measurement instrument, such as a flowmeter. Thus the inexpensive refrigeration cycle apparatus 100 with enhanced ease of maintenance management of devices is obtainable.

The determination of whether a flow-rate fault occurs using the flow rate $G_w$ of the cooling target fluid calculated in Embodiment 1 enables the occurrence of a flow-rate fault in the cooling target fluid flowing in the evaporator 4 to be accurately determined.

When a flow-rate fault is detected by the flow-rate fault determining means, controlling at least one of the compressor 1, pressure-reducing means 3, and cooling target fluid sending means 5 (for example, stopping the operation or reducing the speed of the compressor 1 or the like) can prevent a failure of a device included in the refrigeration cycle apparatus 100.

Embodiment 2

By setting a correction value of the flow rate $G_w$ of the cooling target fluid calculated in Embodiment 1 as described below, the absolute quantity of the cooling target fluid flowing in the evaporator 4 (in other words, the second circuit B) can be calculated with higher precision. The refrigeration cycle apparatus 100 according to Embodiment 2 is described below. The refrigeration circuit, system configuration, and the like of the refrigeration cycle apparatus according to Embodiment 2 are substantially the same as those in the refrigeration cycle apparatus illustrated in Embodiment 1. Accordingly, the same respects in Embodiment 2 as in Embodiment 1 are not described here.

The occurrence of a flow-rate fault for the cooling target fluid is determined in Embodiment 2 using a method similar to that in Embodiment 1. Embodiment 2 differs from Embodiment 1 in that before the determination of whether a flow-rate fault of the cooling target fluid occurs, a correction value of the flow rate $G_w$ of the cooling target fluid is previously determined in a trial run in initial installation or the like. A correcting method is described below.

<<Method of Correcting Flow Rate $G_w$ of Cooling Target Fluid (Flowchart)>>

Figure 7:
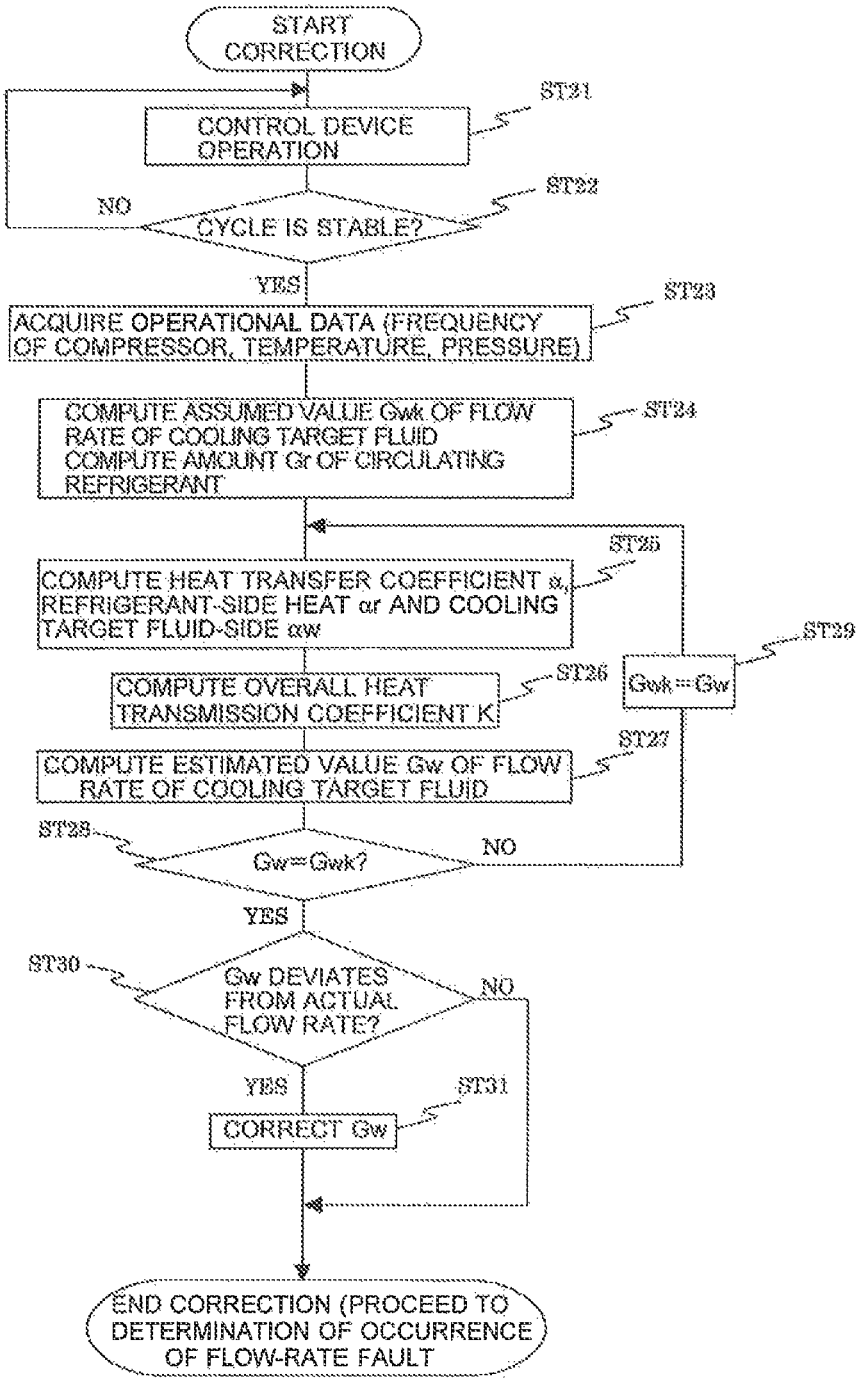
FIG. 7 is a flowchart that illustrates a method of correcting the flow rate $G_w$ of the cooling target fluid according to Embodiment 2 of the present invention.

FIG. 7 is a flowchart that illustrates a method of correcting the flow rate $G_w$ of the cooling target fluid according to Embodiment 2 of the present invention. The method of correcting the flow rate $G_w$ of the cooling target fluid is described below on the basis of FIGS. 7 and 1.

In ST21, the refrigeration cycle apparatus 100 is operated under a predetermined operational condition, and operational control is performed such that the refrigeration cycle apparatus 100 is in an operational state suited for correction of the flow rate of the cooling target fluid. One example of the predetermined operational condition can be the rating of each device in the refrigeration cycle apparatus 100. Another example of the predetermined operational condition can be an operational condition in which the temperature of the cooling target fluid, outside air temperature, operation frequency of the compressor, or the like are specified. In the operational control, each detecting means in the refrigeration cycle apparatus 100 measures operational data on the refrigeration cycle apparatus 100, and each actuator is controlled such that a control value for the actuator calculated from the operational data becomes a desired value. A behavior of controlling each actuator is described below.

For example, the operation frequency of the compressor 1 is adjusted such that a value detected by the cooling target fluid outflow temperature detecting means 23 is equal to a desired value (for example, 7° C.). For example, the opening degree of the pressure-reducing means 3 is adjusted such that the degree of superheat of compressor suction (a value obtained by subtraction of a value in which a pressure value detected by the low-pressure side pressure detecting means 11 is converted into saturation temperature from a value detected by the suction refrigerant temperature detecting means 21) becomes a desired value (for example, 5° C.).

The operational control of achieving an operational state suited for correction of the flow rate of the cooling target fluid is not limited to the above-described control method. For example, the operation frequency of the compressor 1 may be controlled so as to be kept at a constant value. For example, the operation frequency of the compressor 1 may be controlled such that each of the condensing temperature and the evaporating temperature is equal to a desired value. For example, the operation frequency of the compressor 1 may be controlled such that either one of the condensing temperature and the evaporating temperature becomes a desired value. At this time, when the condenser 2 is an air heat exchanger, the rotation speed of the fan may be controlled concurrently.

In ST22, the determining unit 34 determines whether the operational control performed in ST21 is stable. For example, when the degree of superheat of compressor suction or a value detected by the cooling target fluid outflow temperature detecting means 23 is used as a control value, it is determined whether the value is in a predetermined range (for example, ±2% of the desired value or the like). When the result of determination is YES, processing proceeds to ST23. When the result of determination is NO, processing returns to ST21, and the operational control repeats.

ST23 through ST29 are the same as ST1 through ST7 described in Embodiment 1 with reference to FIG. 6 and are not described here.

In ST30, the determining unit 34 determines the necessity or unnecessity of correction from the degree of the deviation of "the flow rate $G_w$ of the cooling target fluid when the result of determination in ST28 is YES" from "the actual flow rate $G_{wa}$ of the cooling target fluid flowing in the evaporator 4 (in other words, the second circuit B)." For example, when the criterion value for determining the necessity or unnecessity of correction is ±5% of the percentage of the deviation from the actual flow rate $G_{wa}$, if the percentage of the deviation is larger than the criterion value, processing proceeds to ST31, where a correction value of the flow rate $G_w$ of the cooling target fluid is determined, processing ends. If the percentage of the difference is smaller than the criterion value, processing ends. After the completion, processing proceeds to the determination of the occurrence of a flow-rate fault illustrated in FIG. 6. The percentage RD_Flow of the deviation of the flow rate $G_w$ of the cooling target fluid from the actual flow rate $G_{wa}$ [%] can be determined from the following Expression (8).

[Math. 8]

$$\text{RD_Flow} = \left(\frac{G_w}{G_{wa}} - 1\right) \times 100 \tag{8}$$

Here, for example, the actual flow rate $G_{wa}$ of the cooling target fluid flowing in the evaporator 4 (in other words, the second circuit B) may be a standard flow rate value under a predetermined operational condition, the standard flow rate value being previously stored in the storage unit 33. Alternatively, for example, the actual flow rate $G_{wa}$ of the cooling target fluid flowing in the evaporator 4 (in other words, the second circuit B) may be directly measured by flow rate measuring means, such as a flowmeter, temporarily connected to the second circuit B.

The correction value determined in ST31 may be a proportionality factor by which the flow rate $G_w$ of the cooling target fluid is directly multiplied, for example. Alternatively, for example, the correction value determined in ST31 may be a proportionality factor by which at least one of values detected by the detecting means used in the stage of computing the flow rate $G_w$ of the cooling target fluid (temperature of the cooling target fluid, low-pressure side pressure of the refrigerant, temperature of the low-pressure refrigerant, and the like) is multiplied, or may be an addition value or a subtraction value for use in correction by being added to or subtracted from a detected value. Alternatively, the correction value determined in ST31 may be a proportionality factor by which a computational value resulting from a value detected by each detecting means used in the stage of computing the flow rate $G_w$ of the cooling target fluid (temperature of the cooling target fluid, low-pressure side pressure of the refrigerant, temperature of the low-pressure refrigerant, and the like) is multiplied. The computational value may indicate ln $\{(T_{wi}-ET)/(T_{wo}-ET)\}$ in the denominator of Expression (7), for example. Correcting the flow rate $G_w$ of the cooling target fluid is corrected by at least one of these correction values and using the corrected value as the flow rate $G_w$ of the cooling target fluid enables more accurate determination of whether a flow-rate fault occurs in FIG. 6 (ST8).

As described above, correcting the flow rate $G_w$ of the cooling target fluid in this way can enhance the accuracy of estimating the flow rate $G_w$ of the cooling target fluid used in the determination of whether a flow-rate fault occurs, and can achieve the determination with high precision.

Embodiment 3

When the refrigeration cycle apparatus 100 is used, the evaporator 4 or the cooling target fluid sending means 5 may become faulty because of deterioration caused by aging or the like. Thus the refrigeration cycle apparatus 100 illustrated in Embodiment 1 or Embodiment 2 may include channel fault determining means described below. The items in Embodiment 3 that are not described are substantially the same as those in Embodiment 1 or Embodiment 2, and the same functions and configurations are described with the same reference numerals.

<<Detection of Fault of Cooling Target Fluid Line (Second Circuit B)>>

Figure 8:
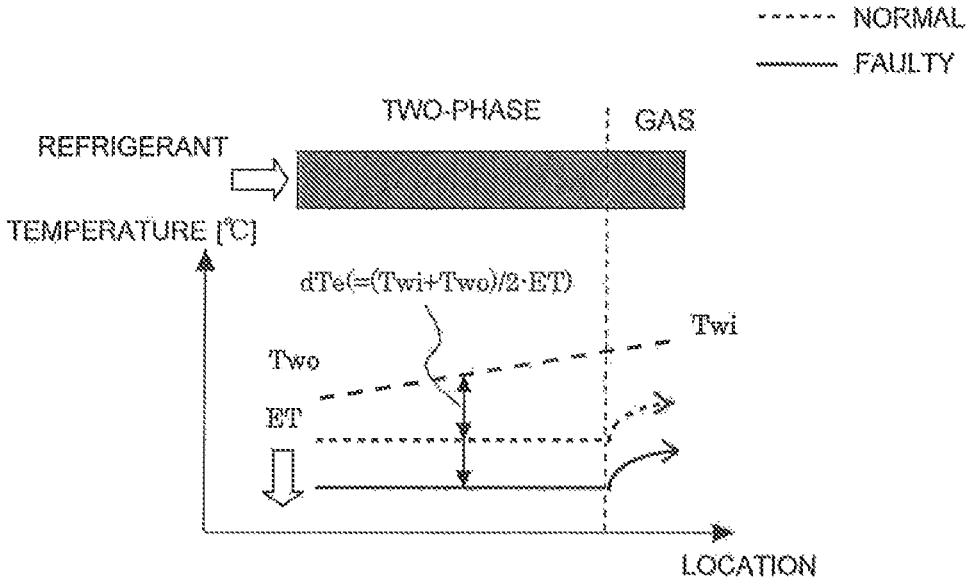
FIG. 8 is a conceptual diagram for describing a method of determining a channel fault in a cooling target fluid line (second circuit B) according to Embodiment 3 of the present invention.

FIG. 8 is a conceptual diagram for describing a method of determining a channel fault in a cooling target fluid line (second circuit B) according to Embodiment 3 of the present invention. The horizontal axis in FIG. 8 indicates the position inside the evaporator 4. The vertical axis in FIG. 8 indicates the temperature of each of the refrigerant and cooling target fluid flowing in the evaporator 4. The broken line with the arrow indicates the temperature of the refrigerant in a normal state, and the solid line with the arrow indicates the temperature of the refrigerant in a faulty state. Here, the normal state is a state where a fault is not occurring in the evaporator 4 or cooling target fluid sending means 5 and the cooling target flows through the second circuit B at an intended flow rate. The faulty state is a state where the function as a heat exchanger of the evaporator 4 is degraded by soiling or breakage of the evaporator 4 or a breakdown of the cooling target fluid sending means 5. The channel fault determining means according to Embodiment 3 is described below using FIG. 8.

The amount Qe of heat exchange between the refrigerant and the cooling target fluid in the evaporator 4 [kW] is expressed as the following Expression (9).

[Math. 9]

$$Q_e = A \times K_h \times \Delta H \tag{9}$$

$K_h$: overall heat transmission coefficient of enthalpy difference criterion [kW/(m$^2$·kJ/kg)]

ΔH: enthalpy difference between refrigerant temperature (evaporating temperature) and cooling target fluid temperature in evaporator [kJ/kg]

If soiling or breakage resulting from deterioration caused by aging or the like occurs in the evaporator 4, the heat transfer area A decreases. If the cooling target fluid sending means 5 suffers a breakdown, the overall heat transmission coefficient $K_h$ decreases. Thus as is clear from Expression (9), in a faulty state, ΔH increases to handle the same load as in a normal state. Accordingly, as illustrated in FIG. 8, in the faulty state, the evaporating temperature ET decreases, and the temperature difference dTe between "the evaporating temperature ET" and "the mean value of the cooling target fluid inflow temperature $T_{wi}$ and the cooling target fluid outflow temperature $T_{wo}$" (that is, $dTe=(T_{wi}+T_{wo})/2-ET$) increases. Thus a channel fault of the second circuit B can be detected using the evaporating temperature ET and dTe as indices.

For example, in an initial operation, dTe in a normal state is stored in the storage unit 33. When a faulty state is set as the state where the value of $A \times K_h$ decreases to 50% of that in the normal state, if the threshold of dTe in the faulty state is set as being twice dTe in the normal state, the occurrence of a channel fault of the second circuit B (soiling or breakage of the evaporator 4, a breakdown of the cooling target fluid sending means 5, or the like) can be determined. This determination is made by the determining unit 34 in Embodiment 3. That is, the determining unit 34 corresponds to channel fault determining means in the present invention.

As described above, providing the refrigeration cycle apparatus 100 with the channel fault determining means according to Embodiment 3 enables soling or breakage of the evaporator 4 or a breakdown of the cooling target fluid sending means 5 to be detected.

Controlling at least one of the compressor 1, pressure-reducing means 3, and cooling target fluid sending means 5 (for example, stopping the operation or reducing the speed of the compressor 1 or the like) when the channel fault determining means detects a fault can prevent other devices included in the refrigeration cycle apparatus 100 that are not broken from suffering a breakdown.

REFERENCE SIGNS LIST

1 compressor, 2 condenser, 3 pressure-reducing means, 4 evaporator, 5 cooling target fluid sending means, 11 low-pressure side pressure detecting means, 12 high-pressure side pressure detecting means, 21 suction refrigerant temperature detecting means, 22 cooling target fluid inflow temperature detecting means, 23 cooling target fluid outflow temperature detecting means, 24 low-pressure refrigerant temperature detecting means, 25 high-pressure refrigerant temperature detecting means, 31 measuring unit, 32 computing unit, 33 storage unit, 34 determining unit, 35 control unit, 36 notifying unit, 40 frequency detecting means, 100 refrigeration cycle apparatus, A first circuit, B second circuit

The invention claimed is:

1. A refrigeration cycle apparatus comprising:

a first circuit in which a compressor that compresses a refrigerant, a condenser that condenses the refrigerant compressed by the compressor, pressure-reducing means for reducing a pressure of the refrigerant condensed by the condenser, and an evaporator that causes the refrigerant with the pressure reduced by the pressure-reducing means to evaporate are connected by piping;

a second circuit in which the evaporator and a pump for sending a cooling target fluid, which is a liquid, to the evaporator, the cooling target fluid exchanging heat with the refrigerant flowing in the evaporator, are connected by piping;

low-pressure side pressure detecting means for detecting the pressure of the refrigerant being sucked by the compressor;

suction refrigerant temperature detecting means for detecting a temperature of the refrigerant being sucked by the compressor;

frequency detecting means for detecting an operation frequency of the compressor;

cooling target fluid inflow temperature detecting means for detecting a cooling target fluid inflow temperature, the cooling target fluid inflow temperature being a temperature of the cooling target fluid flowing in the evaporator;

cooling target fluid outflow temperature detecting means for detecting a cooling target fluid outflow temperature, the cooling target fluid outflow temperature being a temperature of the cooling target fluid flowing out of the evaporator; and flow rate calculating means for calculating an absolute quantity of a flow rate of the cooling target fluid flowing in the evaporator using values detected by the low-pressure side pressure detecting means, the suction refrigerant temperature detecting means, the frequency detecting means, the cooling target fluid inflow temperature detecting means, and the cooling target fluid outflow temperature detecting means, wherein calculating the absolute quantity of the flow rate of the cooling target fluid in the evaporator by the flow rate calculating means includes:

calculating a refrigerant-side heat transfer coefficient of the refrigerant and a cooling target fluid-side heat transfer coefficient of the cooling target fluid, and calculating an overall heat transmission coefficient of the evaporator using the refrigerant-side heat transfer coefficient and the cooling target fluid-side heat transfer coefficient; and wherein the absolute quantity of the flow rate of the cooling target fluid in the evaporator is calculated by the flow rate calculating means using the overall heat transmission coefficient, an evaporating temperature obtained by converting the pressure of the refrigerant detected by the low-pressure side pressure detecting means into a saturation temperature, the cooling target fluid inflow temperature detected by the cooling target fluid inflow temperature detecting means, and the cooling target fluid outflow temperature detected by the cooling target fluid outflow temperature detecting means.

2. The refrigeration cycle apparatus of claim 1, wherein the absolute quantity of the flow rate of the cooling target fluid calculated by the flow rate calculating means under a predetermined operational condition and a previously stored standard flow rate value of the cooling target fluid under the predetermined operational condition are compared to determine a correction value, and the flow rate calculating means corrects, by using the correction value, the absolute quantity of the flow rate of the cooling target fluid calculated by the flow rate calculating means.

3. The refrigeration cycle apparatus of claim 1, wherein the absolute quantity of the flow rate of the cooling target fluid calculated by the flow rate calculating means under a predetermined operational condition and the flow rate of the cooling target fluid having actually flowed in the evaporator when the refrigeration cycle apparatus operates under the predetermined operational condition are compared to determine a correction value, and the flow rate calculating means corrects, by using the correction value, the absolute quantity of the flow rate of the cooling target fluid calculated by the flow rate calculating means.

4. The refrigeration cycle apparatus of claim 2, wherein the correction value is a correction value for use in correcting at least one of values detected by the cooling target fluid inflow temperature detecting means, the cooling target fluid outflow temperature detecting means, and the low-pressure side pressure detecting means.

5. The refrigeration cycle apparatus of claim 2, wherein the correction value is a correction value for use in correcting a value computed using each of the values detected by the cooling target fluid inflow temperature detecting means, the cooling target fluid outflow temperature detecting means, and the low-pressure side pressure detecting means.

6. The refrigeration cycle apparatus of claim 1, further comprising flow-rate fault determining means for determining whether the flow rate of the cooling target fluid flowing in the evaporator is faulty, wherein the flow-rate fault determining means determines whether the flow rate of the cooling target fluid flowing in the evaporator is faulty by comparing the absolute quantity of the flow rate of the cooling target fluid and a previously stored determination criterion flow rate value.

7. The refrigeration cycle apparatus of claim 6, further comprising a notifying unit for notifying a result of the determination made by the flow-rate fault determining means and notifying the absolute quantity of the flow rate of the cooling target fluid.

8. The refrigeration cycle apparatus of claim 1 further comprising:

channel fault determining means that determines whether the second circuit is faulty on the basis of a difference between an evaporating temperature obtained such that the pressure of the refrigerant detected by the low-pressure side pressure detecting means is converted into saturation temperature and a mean value of the cooling target fluid inflow temperature and the cooling target fluid outflow temperature; and a notifying unit for notifying a result of the determination made by the channel fault determining means and notifying the absolute quantity of the flow rate of the cooling target fluid.

9. A method in a refrigeration cycle apparatus, the refrigeration cycle apparatus comprising:

a first circuit in which a compressor that compresses a refrigerant, a condenser that condenses the refrigerant compressed by the compressor, pressure-reducing means for reducing a pressure of the refrigerant condensed by the condenser, and an evaporator that causes the refrigerant with the pressure reduced by the pressure-reducing means to evaporate are connected by piping; and a second circuit in which the evaporator and a pump for sending a cooling target fluid, which is a liquid, to the evaporator, the cooling target fluid exchanging heat with the refrigerant flowing in the evaporator, are connected by piping;

low-pressure side pressure detecting means;

suction refrigerant temperature detecting means;

frequency detecting means;

cooling target fluid inflow temperature detecting means;

cooling target fluid outflow temperature detecting means; and flow rate calculating means, the method comprising:

detecting, by the low-pressure side pressure detecting means, the pressure of the refrigerant being sucked by the compressor;

detecting, by the suction refrigerant temperature detecting means, a temperature of the refrigerant being sucked by the compressor;

detecting, by the frequency detecting means, an operation frequency of the compressor;

detecting, by the cooling target fluid inflow temperature detecting means, a cooling target fluid inflow temperature, the cooling target fluid temperature being a temperature of the cooling target fluid flowing in the evaporator; and detecting, by the cooling target fluid outflow temperature detecting means, a cooling target fluid outflow temperature, the cooling target fluid outflow temperature being a temperature of the cooling target fluid flowing out of the evaporator; and calculating, by the flow rate calculating means, the absolute quantity of a flow rate of the cooling target fluid flowing in the evaporator using values detected by the low-pressure side pressure detecting means, the suction refrigerant temperature detecting means, the frequency detecting means, the cooling target fluid inflow temperature detecting means, and the cooling target fluid outflow temperature detecting means, wherein calculating the absolute quantity of the flow rate of the cooling target fluid in the evaporator by the flow rate calculating means includes:

calculating a refrigerant-side heat transfer coefficient of the refrigerant and a cooling target fluid-side heat transfer coefficient of the cooling target fluid, and calculating an overall heat transmission coefficient of the evaporator using the refrigerant-side heat transfer coefficient and the cooling target fluid-side heat transfer coefficient; and wherein the absolute quantity of the flow rate of the cooling target fluid in the evaporator is calculated by the flow rate calculating means using the overall heat transmission coefficient, an evaporating temperature obtained by converting the pressure of the refrigerant detected by the low-pressure side pressure detecting means into a saturation temperature, the cooling target fluid inflow temperature detected by the cooling target fluid inflow temperature detecting means, and the cooling target fluid outflow temperature detected by the cooling target fluid outflow temperature detecting means.

10. The refrigeration cycle apparatus of claim 1, further comprising low-pressure refrigerant temperature detecting means for detecting the temperature of the low-pressure refrigerant flowing in the evaporator, wherein the flow rate calculating means calculates the absolute quantity of the flow rate of the cooling target fluid flowing in the evaporator further using a value detected by the low-pressure refrigerant temperature detecting means.

11. The refrigeration cycle apparatus of claim 10, wherein the absolute quantity of the flow rate of the cooling target fluid calculated by the flow rate calculating means under a predetermined operational condition and a previously stored standard flow rate value of the cooling target fluid under the predetermined operational condition are compared to determine a correction value;

the flow rate calculating means corrects, by using the correction value, the absolute quantity of the flow rate of the cooling target fluid calculated by the flow rate calculating means; and the correction value is a correction value for use in correcting at least one of values detected by the cooling target fluid inflow temperature detecting means, the cooling target fluid outflow temperature detecting means, and the low-pressure refrigerant temperature detecting means.

12. The refrigeration cycle apparatus of claim 10, wherein the absolute quantity of the flow rate of the cooling target fluid calculated by the flow rate calculating means under a predetermined operational condition and a previously stored standard flow rate value of the cooling target fluid under the predetermined operational condition are compared to determine a correction value, the flow rate calculating means corrects, by using the correction value, the absolute quantity of the flow rate of the cooling target fluid calculated by the flow rate calculating means, and the correction value is a correction value for use in correcting a value computed using each of the values detected by the cooling target fluid inflow temperature detecting means, the cooling target fluid outflow temperature detecting means, and the low-pressure refrigerant temperature detecting means.

13. The refrigeration cycle apparatus of claim 10, wherein the flow rate calculating means calculates the absolute quantity of the cooling target fluid flowing in the evaporator using the overall heat transmission coefficient, the evaporating temperature detected by the low-pressure refrigerant temperature detecting means rather than by converting the pressure of the refrigerant detected by the low-pressure side pressure detecting means into a saturation temperature, the cooling target fluid inflow temperature detected by the cooling target fluid inflow temperature detecting means, and the cooling target fluid outflow temperature detected by the cooling target fluid outflow temperature detecting means.

* * * * *